US011326538B2

(12) United States Patent
Kato et al.

(10) Patent No.: US 11,326,538 B2
(45) Date of Patent: May 10, 2022

(54) INJECTION CONTROL DEVICE

(71) Applicant: DENSO CORPORATION, Kariya (JP)

(72) Inventors: Kosuke Kato, Kariya (JP); Hiroyuki Fukuda, Kariya (JP); Yasumasa Ishikawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/375,918

(22) Filed: Jul. 14, 2021

(65) Prior Publication Data

US 2022/0018301 A1 Jan. 20, 2022

(30) Foreign Application Priority Data

Jul. 16, 2020 (JP) ..... JP2020-122093

(51) Int. Cl.
*F02D 41/20* (2006.01)
*F02D 41/24* (2006.01)
*F02D 41/26* (2006.01)

(52) U.S. Cl.
CPC ..... *F02D 41/20* (2013.01); *F02D 41/2467* (2013.01); *F02D 41/26* (2013.01); *F02D 2041/2034* (2013.01); *F02D 2041/2058* (2013.01); *F02D 2041/2065* (2013.01)

(58) Field of Classification Search
CPC ..... F02D 41/20; F02D 41/2467; F02D 41/26; F02D 2041/2034; F02D 2041/2058; F02D 2041/2065
See application file for complete search history.

(56) References Cited

U.S. PATENT DOCUMENTS 5,050,562 A * 9/1991 Ishii ..... F02D 41/2454 123/406.44
6,694,945 B2 * 2/2004 Kawaguchi ..... F02D 41/248 123/299
7,899,603 B2 * 3/2011 Yamamoto ..... F02D 41/2438 701/104
8,739,764 B2 * 6/2014 Nakamura ..... F02D 41/2467 123/479
9,835,105 B2 * 12/2017 Yanoto ..... F02D 41/20
10,156,199 B2 * 12/2018 Nakano ..... F02D 41/2467
10,280,864 B2 * 5/2019 Yanoto ..... F02D 41/401
10,428,755 B2 * 10/2019 Yanoto ..... F02M 51/061
(Continued)

FOREIGN PATENT DOCUMENTS

JP 2016-033343 A 3/2016

*Primary Examiner* — Phutthiwat Wongwian
*Assistant Examiner* — Susan E Scharpf
(74) *Attorney, Agent, or Firm* — Posz Law Group, PLC

(57) ABSTRACT

An injection control device for a fuel injection valve includes: a current detection unit of the fuel injection valve; a current area correction control unit that performs current area correction for an area correction amount of an energization time to equalize the integrated current value of the energization current profile and an integrated current value of the detected current; and an information correction unit that learns and stores a reference attainment time, from a start of energization to an attainment of each of the plurality of reference currents, in a storage unit, and corrects information related to the current area correction based on a difference between the reference attainment time and an actual attainment time from the start of energization to the attainment of each reference current.

3 Claims, 4 Drawing Sheets

(56) References Cited

U.S. PATENT DOCUMENTS

| | | | | |
|---|---|---|---|---|
| 10,718,290 | B2 * | 7/2020 | Yoshiume | F02D 41/0255 |
| 11,181,064 | B2 * | 11/2021 | Inaba | F02D 41/38 |
| 11,181,066 | B2 * | 11/2021 | Inaba | F02M 51/061 |
| 11,181,067 | B1 * | 11/2021 | Kato | F02D 41/38 |
| 11,181,068 | B1 * | 11/2021 | Kato | F02D 41/20 |
| 2008/0184968 | A1 * | 8/2008 | Matsuura | F02D 41/20 123/490 |
| 2008/0228374 | A1 * | 9/2008 | Ishizuka | F02D 41/3836 701/103 |
| 2009/0055084 | A1 * | 2/2009 | Ishizuka | F02D 41/40 701/105 |
| 2018/0209373 | A1 * | 7/2018 | Yoshiume | F02M 61/10 |
| 2020/0141347 | A1 * | 5/2020 | Yanoto | F02D 41/2467 |
| 2020/0284214 | A1 * | 9/2020 | Inaba | F02D 41/40 |
| 2021/0372337 | A1 * | 12/2021 | Yoshikawa | F02D 41/20 |
| 2021/0372338 | A1 * | 12/2021 | Suganuma | F02D 41/20 |
| 2021/0372340 | A1 * | 12/2021 | Suganuma | F02D 41/221 |

* cited by examiner (a): DETECTED VAL @ NORMAL TEMP
(b): DETECTED VAL @ HIGH TEMP

INJECTION CONTROL DEVICE

CROSS REFERENCE TO RELATED APPLICATION

The present application claims the benefit of priority from Japanese Patent Application No. 2020-122093 filed on Jul. 16, 2020. The entire disclosure of the above application is incorporated herein by reference.

TECHNICAL FIELD

The present invention relates to an injection control device for controlling fuel injection to an internal combustion engine by driving a fuel injection valve with a current.

BACKGROUND

The injection control device is used for injecting fuel into an internal combustion engine, for example, an automobile engine, by opening and closing a fuel injection valve called an injector. The injection control device controls the valve opening by energizing a current to an electrically drivable fuel injection valve. In recent years, along with the strengthening of particle number (PN) regulations, minute injection, that is, partial lift injection, has been used frequently, and high injection accuracy is required for improving fuel efficiency and reducing the amount of toxic substance emission. Therefore, an energization current profile corresponding to the commanded injection amount is determined, and the injection control device performs valve-opening control to apply a current to the fuel injection valve on the basis of the energization current profile.

SUMMARY

According to an example, an injection control device for a fuel injection valve includes: a current detection unit of the fuel injection valve; a current area correction control unit that performs current area correction for an area correction amount of an energization time to equalize the integrated current value of the energization current profile and an integrated current value of the detected current; and an information correction unit that learns and stores a reference attainment time, from a start of energization to an attainment of each of the plurality of reference currents, in a storage unit, and corrects information related to the current area correction based on a difference between the reference attainment time and an actual attainment time from the start of energization to the attainment of each reference current.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

In the control of the fuel injection valve, the gradient of the energization current of the fuel injection valve may be lower than the energization current profile due to various factors such as ambient temperature environment or aging deterioration, and the actual injection amount may be lower than the commanded injection amount. With the fuel injection amount being obtained in accordance with the integrated value of the energization current, the applicant of the present invention has developed a technique for correcting a current area by monitoring the current when the fuel injection valve is driven, detecting the slope of the energization current, and correcting the energization time so as to extend the energization time in accordance with the slope, and the applicant has previously filed the technique (Japanese Patent Application No. 2019-41574).

Figure 5:
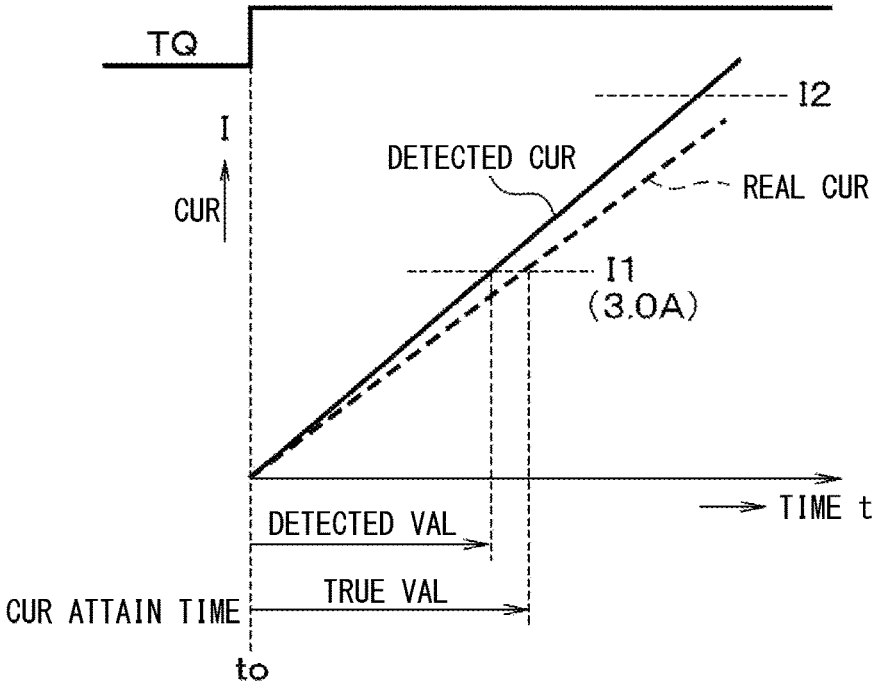
FIG. 5 is a diagram illustrating an example of a situation in which an error has occurred between the detected current value and the true value.

When the current area is to be corrected in the energization control of the fuel injection valve, there is performed processing for obtaining the difference from the energization current profile on the basis of the measurement of the time from the start of energization to the attainment at each of predetermined reference current values I1, I2. However, there are cases where a circuit error has occurred in a detected current value of a current detection unit. For example, as illustrated in FIG. 5, even when the current detection unit detects that the current has reached 3.0 A, which is the reference current value I1, the actual current value may be 2.9 A. Due to such a circuit error, there is a possibility that the current area correction cannot be performed accurately.

Accordingly, in view of the above points, an injection control device is provided such that performs current area correction based on an integrated value of an energization current in energization control of a fuel injection valve and can perform the current area correction more accurately.

In order to achieve the above object, the injection control device has: a current detection unit that detects the current value flowing through the fuel injection valve; a current area correction control unit that performs current area correction to make a correction by calculating, on the basis of an energization current profile showing a relationship between an energization time and an energization current value so as to obtain an integrated energization current value corresponding to a fuel injection amount command value, an area correction amount of an energization time on the basis of a difference between the integrated current value of the energization current profile and an integrated current value of the current value detected by the current detection unit so that the integrated current values become equivalent; and an information correction unit that learns the reference attainment time from the start of energization to the attainment of a plurality of reference currents when the fuel injection valve is driven under a predetermined voltage and temperature condition and stores the reference attainment time in a storage unit, and corrects the information related to the current area correction based on the difference between the actual attainment time from the start of energization to the attainment of each reference current and the reference attainment time at the time of driving of the fuel injection valve thereafter.

According to the above configuration, at the time of performing the current control on the fuel injection valve, since the fuel injection amount corresponding to the integrated value of the energization current is obtained, the current area correction control unit calculates the area correction amount of the energization time on the basis of the difference between the integrated current of the energization current profile and the integrated current of the value of the current flowing through the fuel injection valve detected by the current detection unit so that the integrated current values become equivalent, and performs the current area correction. In this case, in general, the slope of the actual current value detected by the current detection unit deviates to a smaller value from an ideal slope of the energization current shown in the energization current profile. Therefore, by performing the current area correction, it is possible to obtain the integrated value of the energization current for the fuel injection valve corresponding to the fuel injection amount command value and consequently obtain an appropriate fuel injection amount.

Here, when a circuit error has occurred in the detected current value in the current detection unit, there is a possibility that the current area correction cannot be performed accurately. At this time, the energization time and the current value flowing through the fuel injection valve are in a substantially linear proportional relationship, and the circuit error of the current detection unit with respect to the relationship between the reference energization time and the current value, that is, the reference inclination appears as a deviation of the inclination with respect to the reference. Focusing on this point, the reference attainment time from the start of energization to the attainment of a plurality of reference currents when the fuel injection valve is driven under a predetermined voltage and temperature condition is learned and stored as a reference value in the storage unit.

Then, the information correction unit corrects the information regarding the current area correction based on the difference between the actual attainment time from the start of energization to the attainment of each reference current and the reference attainment time stored in the storage unit when the fuel injection valve is driven thereafter. As the information used for the current area correction at this time, for example, the value of the reference current itself can be corrected. In addition to that, it is also possible to correct the current value itself detected by the current detection unit, the attainment time at which each reference current is reached, the correction amount ΔTi, and the like. In either case, the correction makes it possible to correct the current area more accurately.

As a result, even if there is a circuit error in the detected current value in the current detection unit, the information correction unit make a correction to cancel the error between the detected current value of the current detection unit and the actual current value. After that, the current area correction control unit can calculate the area correction amount and perform the current area correction. Therefore, the current area correction is performed based on the integrated value of the energization current in the energization control of the fuel injection valve, and it is possible to obtain an excellent effect that the current area correction control can be performed more accurately.

Figure 1:
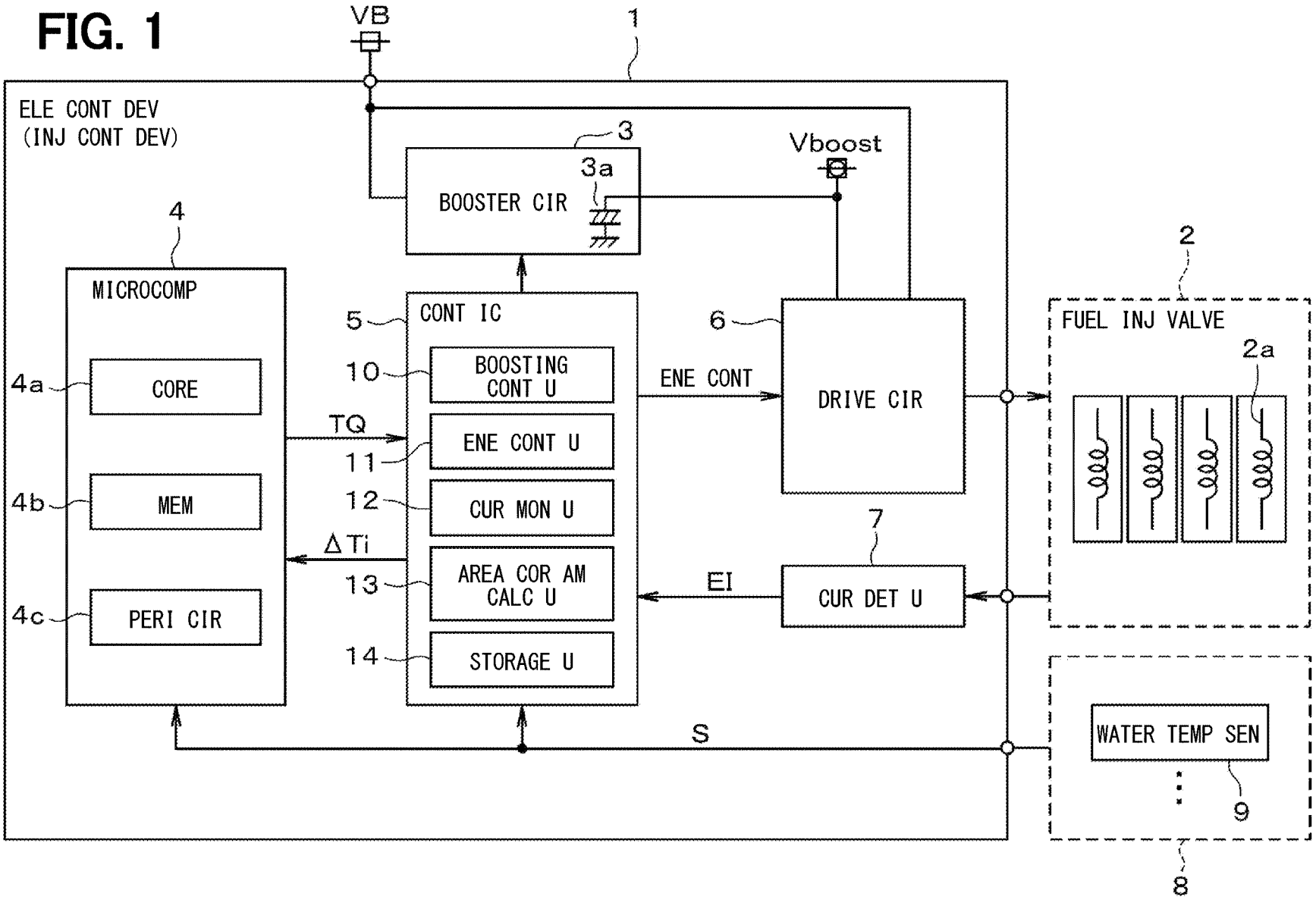
FIG. 1 is a block diagram illustrating an electrical configuration of an injection control device according to an embodiment.

Hereinafter, an embodiment applied to direct injection control of a gasoline engine of an automobile as an internal combustion engine will be described with reference to the drawings. An electronic control device 1 as an injection control device according to the present embodiment is referred to as an electronic control unit (ECU) and controls fuel injection of a fuel injection valve 2 provided in each cylinder of an engine, as illustrated in FIG. 1. The fuel injection valve 2, also referred to as an injector, energizes a solenoid coil 2*a* to drive a needle valve, thereby directly injecting fuel into each cylinder of the engine. In FIG. 1, a four-cylinder engine is used as an example, but the present invention can also be applied to a three-cylinder engine, a six-cylinder engine, an eight-cylinder engine, and the like. The present invention may also be applied to an injection control device for a diesel engine.

As illustrated in FIG. 1, the electronic control device 1 has an electrical configuration as a booster circuit 3, a microcomputer 4, a control integrated circuit (IC) 5, a drive circuit 6, and a current detection unit 7. The microcomputer 4 includes one or more cores 4*a*, a memory 4*b* such as read-only memory (ROM) and random-access memory (RAM), and a peripheral circuit 4*c* such as an analog-to-digital (A/D) converter. Sensor signals S from various sensors 8 for detecting the driving state of the engine are input into the microcomputer 4. As will be described later, the microcomputer 4 obtains the command value of the fuel injection amount on the basis of a program stored in the memory 4*b*, the sensor signals S acquired from the various sensors 8, and the like.

At this time, the various sensors 8 include a water temperature sensor 9 configured to detect the temperature of the cooling water of the engine. In the present embodiment, the water temperature sensor 9 functions as a sensor that detects temperature information correlated with the temperature of the solenoid coil 2*a* of the fuel injection valve 2. The detected water temperature of the water temperature sensor 9 is input to the control IC 5. Although not illustrated, in addition to the above, the various sensors 8 also include an air-fuel ratio (A/F) sensor that detects an air-fuel ratio of exhaust gas, a crank angle sensor that detects the crank angle of the engine, an airflow meter that detects the intake air amount of the engine, a fuel pressure sensor that detects the fuel pressure when the fuel is injected into the engine, a throttle opening sensor that detects a throttle opening, and the like. In FIG. 1, the sensors 8 are illustrated in a simplified manner.

The core 4*a* of the microcomputer 4 functions as a fuel injection amount command value output unit. The fuel injection amount command value output unit grasps the load of the engine from the sensor signals S of the various sensors 8 and calculates the required fuel injection amount of the fuel injection valve 2 on the basis of the engine load. Then, the calculated amount is output as a fuel injection amount command value TQ to the control IC 5 together with the injection start instruction time t0. At this time, although a detailed description is omitted, an A/F correction amount is calculated so as to become a target air-fuel ratio on the basis of the air-fuel ratio detected by the A/F sensor, and air-fuel ratio feedback control is performed. Further, A/F learning is performed on the basis of the history of A/F correction, and the learning correction value is added to the calculation of the A/F correction amount.

The control IC 5 is, for example, an integrated circuit device using an application-specific integrated circuit (ASIC) and, although not illustrated, the control IC 5 includes a control body such as a logic circuit and a central processing unit (CPU), a storage unit such as RAM, ROM, an erasable programmable read-only memory (EEPROM), comparator equipment using a comparator, and the like, for example. The control IC 5 performs the current control of the fuel injection valve 2 via the drive circuit 6 in accordance with the hardware and software configuration of the control IC 5. At this time, the control IC 5 performs current area correction control to be described later in driving the fuel injection valve 2. The control IC 5 has functions as a boosting control unit 10, an energization control unit 11, a current monitoring unit 12, an area correction amount calculation unit 13, and a storage unit 14.

Although not illustrated in detail, the booster circuit 3 is configured to receive input of a battery voltage VB, boost the battery voltage VB, and charge the booster capacitor 3*a* serving as a charge unit with a boosting voltage Vboost. At this time, the boosting control unit 10 controls the operation of the booster circuit 3, performs boosting control on the input battery voltage VB, and charges the booster capacitor 3*a* with the boosting voltage Vboost to a fully charged voltage. The boosting voltage Vboost is, for example, 65 V, and is supplied to the drive circuit 6 as power for driving the fuel injection valve 2. This boosted voltage Vboost is set to a predetermined voltage.

The battery voltage VB and the boosting voltage Vboost are input into the drive circuit 6. Although not illustrated, the drive circuit 6 includes a transistor for applying the boosting voltage Vboost to the solenoid coil 2*a* of the fuel injection valve 2 in each cylinder, a transistor for applying the battery voltage VB, a cylinder selecting transistor for selecting a cylinder to be energized, and the like. At this time, each transistor of the drive circuit 6 is turned on and off by the energization control unit 11. Thereby, on the basis of the energization control of the energization control unit 11, the drive circuit 6 applies a voltage to the solenoid coil 2*a* to drive the fuel injection valve 2.

The current detection unit 7 is made of a current detection resistor (not illustrated) or the like and detects a current flowing through the solenoid coil 2*a*. The current monitoring unit 12 of the control IC 5 is configured using, for example, a comparison unit made of a comparator, an A/D converter, or the like (not illustrated) and monitors, through the current detection unit 7, an energization current value EI of a current flowing through the solenoid coil 2*a* of the fuel injection valve 2 in each cylinder. Here, there are cases where a circuit error has occurred in the detected current value of the current detection unit 7. For example, as illustrated in FIG. 5, even when the current detection unit 7 detects that the current has reached 3.0 A, which is one reference current value I1, the actual current value may be 2.9 A. Therefore, in the present embodiment, the current monitor unit 12 has a function as an information correction unit. The function of this information correction unit will be described later.

Figure 2:
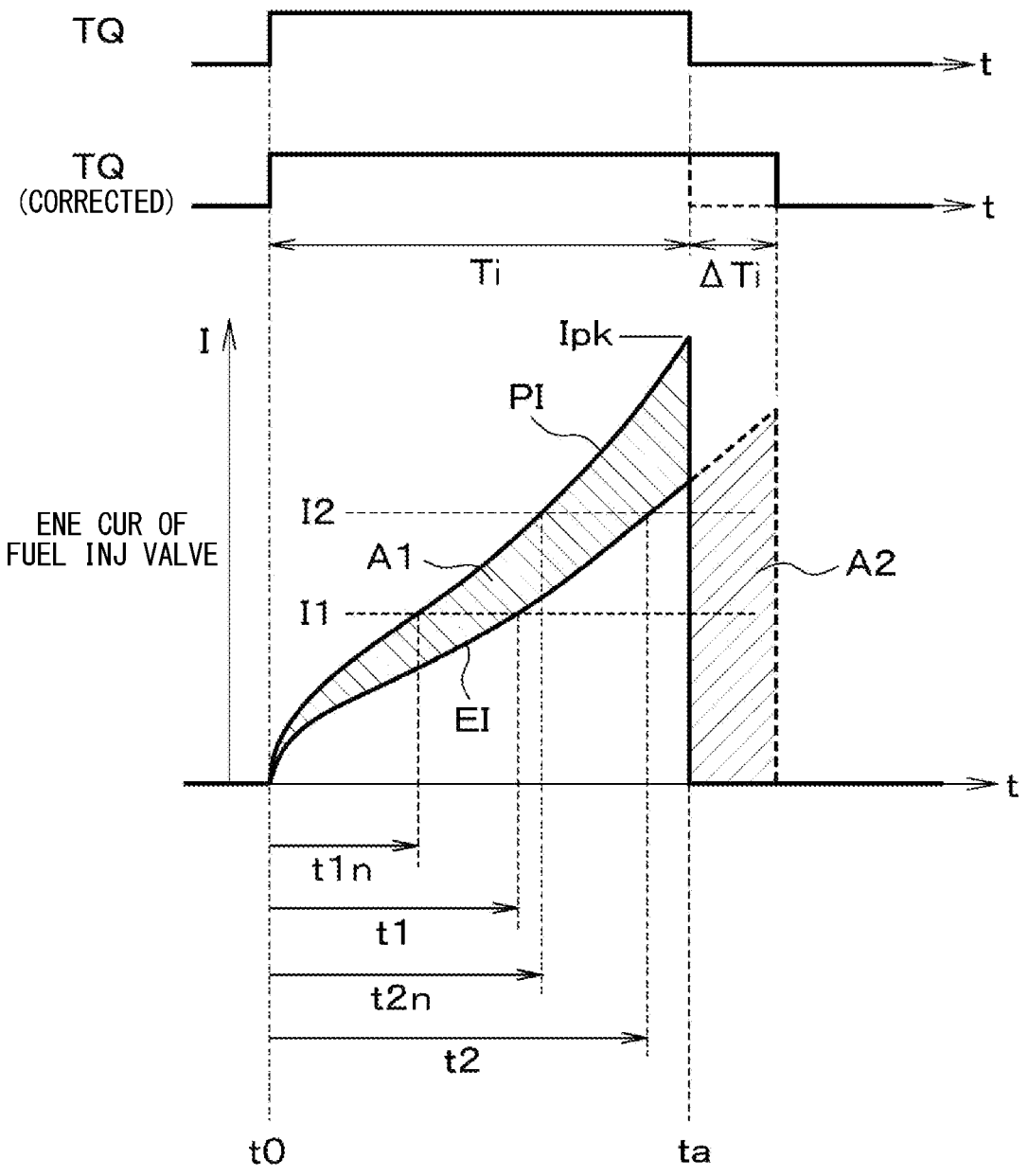
FIG. 2 is a diagram illustrating the relationship between the energization time and the energization current of the fuel injection valve for explaining the current area correction control.

As illustrated in FIG. 2, the control IC 5 stores an energization current profile PI illustrating an ideal relationship between an energization time Ti and an energization current value so as to obtain an integrated energization current value of the fuel injection valve 2 corresponding to the fuel injection amount command value TQ. The energization control unit 11 of a control IC 5 performs current control on the fuel injection valve 2 via the drive circuit 6 on the basis of the energization current profile PI. At this time, in the control of the fuel injection valve 2, the gradient of the energization current of the fuel injection valve 2 is lower than the energization current profile PI due to various factors such as ambient temperature environment and aging deterioration, and the actual injection amount is lower than the commanded injection amount. On the other hand, at the time of controlling the energization of the fuel injection valve 2, a fuel injection amount corresponding to, that is, proportional to, the integrated value of the energization current is obtained.

Therefore, the energization control unit 11 is configured to perform current area correction to make a correction by calculating an area correction amount ΔTi of the energization time on the basis of the difference between the integrated current of the energization current profile PI and the integrated current of the energization current value EI of the current actually flowing in the fuel injection valve 2 detected by the current detection unit 7 so that the current values become equivalent. With reference to FIG. 2, a brief description will be given of the current area correction control performed by the energization control unit 11 of the control IC 5 in a case where the partial lift injection of the fuel injection valve 2 is performed.

That is, in the control based on the energization current profile PI, when the energization is started from on-timing t0, the energization current gradually rises while drawing a slight curve, and by the energization for the energization time Ti, the current reaches a peak current Ipk at time ta, so that the fuel injection amount of the fuel injection amount command value TQ is obtained. However, the actual energization current value EI of the fuel injection valve 2 rises while drawing a curve with a gentler slope and becomes a current value lower than the peak current Ipk at time ta. Thus, there is a shortage of the fuel injection quantity by a quantity corresponding to the difference between the integrated current value of the energization current profile PI and the integrated current value of the energization current value EI, in other words, the area in the graph between the curve of the energization current profile PI and the curve of the energization current value EI from the time t0 to the time ta in FIG. 2, that is, an area difference A1.

In the current area correction control, the area correction amount ΔTi of the energization time is calculated by the area correction amount calculation unit 13. The area correction amount ΔTi is determined so that the integrated current values of the energization current profile PI and the energization current value EI become equivalent, that is, the area difference A1 and an area A2 in FIG. 2 become equivalent. Then, with the calculated area correction amount ΔTi, the energization control unit 11 corrects, that is, extends, the energization time to compensate for the shortage of the fuel injection amount described above.

As a method for calculating the area correction amount ΔTi, for example, the following method can be used in the energization current profile PI and the detected energization current value EI, respectively, a plurality of reference current values, which are time tin and time t1 for reaching a first reference current value I1 in this case, from the start of energization are obtained, and time t2*n* and time t2 for reaching a second reference current value I2 are obtained. The first reference current value I1 and the second reference current value I2 are, for example, 3.0 A and 6.0 A, respectively. Then, the area difference A1 is estimated from the attainment times, and the area correction amount ΔTi so as to obtain the area A2 equivalent to the area difference A1 is calculated. By performing the current area correction control as described above, it is possible to obtain an appropriate fuel injection amount of the fuel injection valve 2 corresponding to the fuel injection amount command value TQ.

As described above, there are cases where circuit error has occurred in the detected current value in the current detection unit 7, and in such cases, the correct current value is not obtained, and hence there is a possibility that the current area correction cannot be performed correctly. At this time, when the relationship between an energization time t and a current value I flowing through the solenoid coil 2*a* of the fuel injection valve 2 is observed, the relationship is a proportional relationship that changes almost linearly. As shown in FIG. 5, when the current detection unit 7 has a circuit error with respect to the relationship between the energization time t and the current value I in the case of nominal in which no circuit error exists, it appears as a deviation of inclination. With attention focused on this point, it is possible to perform the correction by regarding the difference in time between the nominal and actual drive until a predetermined current value is reached as the difference between the actual current value and the detected current value.

Therefore, in the present embodiment, the storage unit 14 stores the reference attainment time from the start of energization to the attainment of a plurality of reference currents learned when the fuel injection valve 2 is driven under a predetermined voltage and temperature condition. The predetermined voltage is a boosted voltage Vboost, for example 65V, and the predetermined temperature condition is room temperature, that is, 20° C. Further, a plurality of reference current values, in this case, the reference attainment time ts1 until the first reference current value I1 is reached, and the reference attainment time ts2 which is the reference until the second reference current value I2 is reached, are stored.

In this case, the storage unit 14 stores the reference attainment times ts1 and ts2 when the fuel injection valve 2 is first driven under a predetermined voltage and temperature condition, and thereafter, even time the driving of the fuel injection valve 2 is repeated, the reference attainment times ts1 and ts2 are constantly learned, and the reference attainment times ts1 and ts2 in the storage unit 14 are updated. The storage unit 14 stores the first reference attainment times ts1 and ts2 at appropriate timings such as a test before product shipment and a first actual use.

The current monitoring unit 12 is configured to correct the reference current values I1 and I2 used for the current area correction control as information on the current area correction, based on the detection attainment time from the start of energization of the fuel injection valve 2 during actual driving until the reference current values I1 and I2 are reached, respectively, and the time difference Δt between the reference attainment times ts1 and ts2 stored in the storage unit 14. The corrected reference current values I1, I2 are used for detecting time t1 and time t2 at the actual drive of the fuel injection valve 2. Therefore, the current monitor unit 12 functions as an information correction unit.

Although detailed description is omitted, the correction of the reference current values I1 and I2 is performed by calculating the current correction coefficient for correcting the reference current values I1 and I2 based on the time difference Δt between the detection attainment time at each reference current value I1 and I2 and the reference attainment times ts1 and ts2, respectively, and multiplying the current correction coefficient by each of the reference current values I1 and I2. The current correction coefficient is calculated based on the proportional relationship between the time difference Δt and the current correction coefficient. When there is no deviation in the detected current value, that is, when the time difference Δt is 0, the current correction coefficient is 1. When the time difference Δt is greater than 0, the correction coefficient is also greater than 1.

Figure 4:
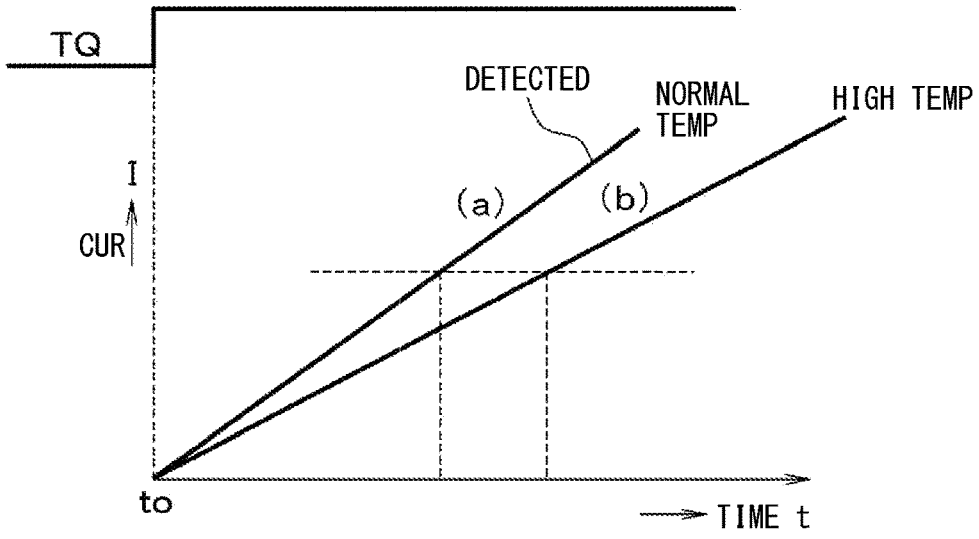
FIG. 4 is a diagram showing the relationship between the passage of time and the current value for two types of temperatures.

Further, as described above, the reference attainment times ts1 and ts2 stored in the storage unit 14 are the attainment times of the fuel injection valve 2 at room temperature, that is, at 20° C. However, as shown in FIG. 4, when the temperature is normal temperature, that is, relatively low as in (a), depending on the temperature of the solenoid coil 2*a* of the fuel injection valve 2, the inclination of the increase of the current value becomes relatively large with the elapsed time. In contrast, when the temperature is high, that is, relatively high, as shown in (b), the slope of the increase of the current value is relatively small. The time to reach a predetermined current value may differ depending on whether the temperature is normal temperature or high temperature.

In the present embodiment, when learning the reference attainment times ts1 and ts2 at the time of actual fuel injection, the current monitoring unit 12 uses the water temperature detected by the water temperature sensor 9, and performs the correction to convert the reference attainment times ts1 and ts2 to be at room temperature, that is, at 20° C. using the temperature correction coefficient Ct according to the detected water temperature. As a function for obtaining the temperature correction coefficient Ct with respect to the detected water temperature is illustrated in block B1 of FIG. 3, the temperature correction coefficient Ct has a relationship of a linear function having a negative slope that decreases as the detected water temperature increases. When the detection temperature is 20° C., the temperature correction coefficient Ct is 1, when the detection temperature is higher than 20° C., the temperature correction coefficient Ct is smaller than 1, and when the detection temperature is lower than 20° C., the temperature correction coefficient Ct is greater than 1.

Next, the operation and effect of the electronic control device 1 configured as described above will be described. According to the electronic control device 1 having the above configuration, at the time when the microcomputer 4 and the control IC 5 perform the current control on the fuel injection valve 2, the current area correction control is performed by utilizing the fact that the fuel injection amount corresponding to the integrated value of the energization current of the fuel injection valve 2 is obtained. In the current area correction control, as illustrated in FIG. 2, the current area correction is performed by calculating the area correction amount ΔTi of the energization time on the basis of the difference between the integrated current of the energization current profile PI and the integrated current of the energization current value EI of the current flowing in the fuel injection valve 2 detected by the current detection unit 7 so that the integrated current values become equivalent.

In this case, in general, the slope of the actual current value EI flowing through the solenoid coil 2*a* of the fuel injection valve 2 deviates to a smaller value from an ideal slope of the energization current shown in the energization current profile PI. Therefore, by performing the current area correction as thus described, it is possible to compensate for the shortage of the actual integrated energization current value of the fuel injection valve 2, that is, the fuel injection amount, corresponding to the fuel injection amount command value TQ and to obtain an appropriate fuel injection amount.

Here, when a circuit error has occurred in the detected current value in the current detection unit 7, there is a possibility that the current area correction cannot be performed accurately. At this time, as illustrated in FIGS. 4 and 5, the energization time and the value of the current flowing through the fuel injection valve 2 have a nearly linear proportional relationship, and a circuit error appears as a deviation of a slope with respect to the relationship between the nominal energization time and the current value without a circuit error. With attention focused on this point, the difference in time between the nominal and the actual from the start of energization to the attainment at a predetermined current value can be regarded as an error in the current value. In the present embodiment, the current monitoring unit 12 corrects the reference current values I1, I2 on the basis of the time difference Δt between the detected attainment time from the energization start t0 to the attainment at each of the reference current values I1, I2 at the time of actual drive and the reference attainment time ts1, ts2 stored in the storage unit 14.

Figure 3:
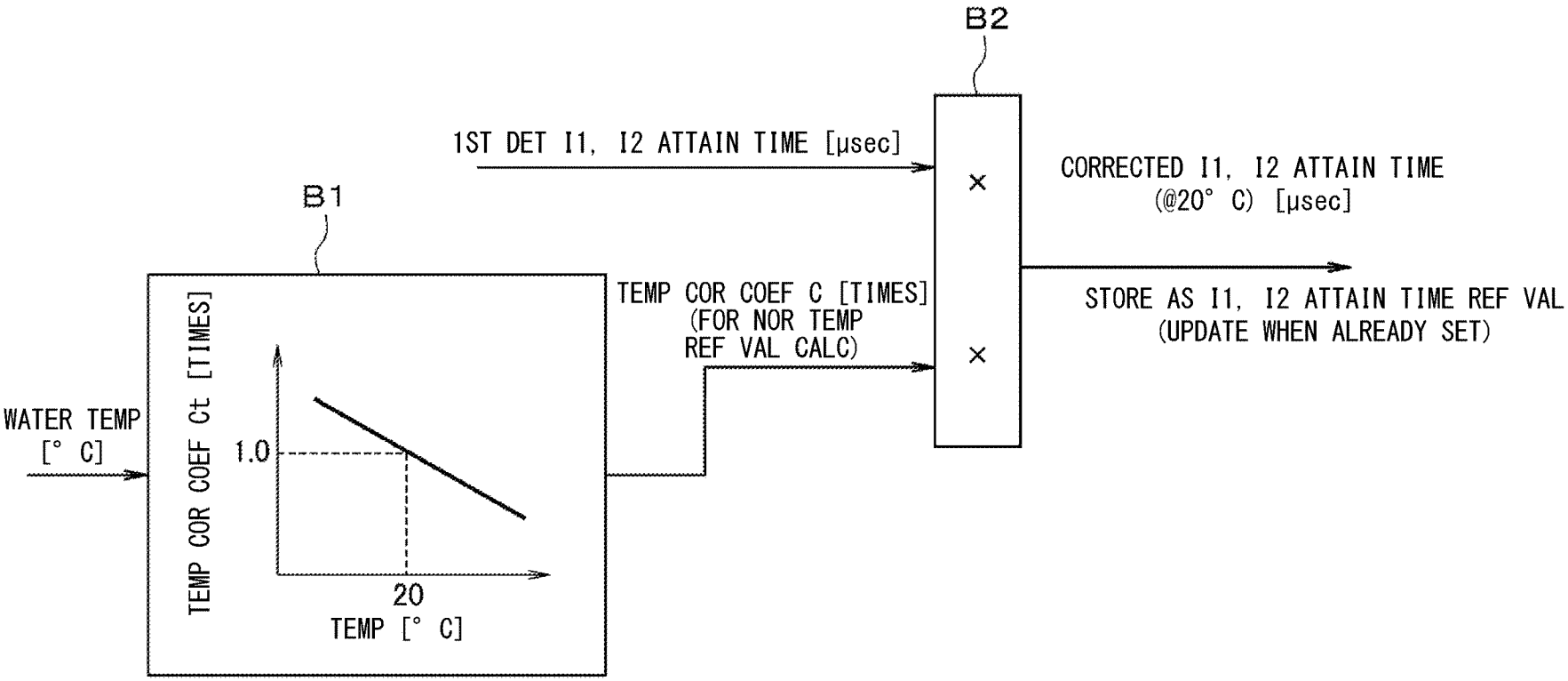
FIG. 3 is a block diagram showing a process of learning control of a reference attainment time.

FIG. 3 is a block diagram showing a learning process system of reference attainment times ts1 and ts2 executed by the current monitor unit 12. That is, in block B1, on the basis of the input of the detected water temperature of the water temperature sensor 9, the temperature correction coefficient Ct is obtained in accordance with a function illustrated in the drawing and is output. In next block B2, each of the detected attainment times ts1, ts2 of the attainment at the reference current values I1, I2 based on the detection by the current detection unit 7 and each of the reference attainment times stored in the storage unit 14 is multiplied by the temperature correction coefficient Ct. As a result, the reference attainment times ts1 and ts2 under arbitrary temperature conditions are corrected so as to be converted into the values at room temperature. The corrected reference attainment times ts1 and ts2 are stored and updated in the storage unit 14.

As a result, the latest and normal temperature-converted reference attainment times ts1 and ts2 are always learned, and the current area correction control can be performed using the reference attainment times ts1 and ts2 stored in the storage unit 14. Therefore, even if there is a circuit error in the detected current value in the current detection unit 7, for example, the reference current values I1 and I2 used for the current area correction control can be corrected to a value that cancels the error with the actual current value in view of the estimation of the circuit error in the current detection unit 7. Thus, even when a circuit error has occurred in the current detection unit 7, the current area correction control can be performed accurately.

As described above, according to the present embodiment, in the energization control of the fuel injection valve 2, the current area is corrected based on the integrated value of the energizing current, and this current area correction can be performed under a condition that the learning of the reference attainment times ts1 and ts2 for cancelling the error between the detected current value and the actual current value of the current detection unit 7 is performed even if a circuit error occurs in the detected current value in the current detection unit 7. As a result, it is possible to obtain an excellent effect that current area correction control can be performed more accurately.

In addition, the attainment time from the start of energization of the fuel injection valve 2 to the attainment at each of the reference current values I1, I2 varies depending on the temperature of the fuel injection valve 2. In the present embodiment, the reference attainment time ts1, ts2 stored in the storage unit 14 is set to the attainment time at the normal temperature of the fuel injection valve 2, which is a specific temperature condition. Then, at the time of actual driving, the reference attainment time ts1 and ts2 are learned while converting to room temperature using the temperature correction coefficient.

As a result, even if the temperature conditions are not predetermined, the reference attainment times ts1 and ts2 can be learned and stored in the storage unit 14. Therefore, even when the temperature conditions are different, the reference attainment times ts1 and ts2 can be learned, and better control becomes possible. At this time, it is difficult to directly detect the temperature of the solenoid coil 2*a* of the fuel injection valve 2. However, the temperature of the solenoid coil 2*a* of the fuel injection valve 2 and the cooling water temperature of the engine have a proportional correlation, and in the present embodiment, by using the water temperature sensor 9 of the engine having a correlation with the temperature of the fuel injection valve 2, temperature detection can be easily performed without increasing the number of sensors.

In the above embodiment, the method has been adopted in which, at the time of performing the current area correction control on the fuel injection valve 2, in the energization current profile PI and the detected energization current value EI, respectively, time tin and time t1 at which the reference current value I1 is reached and time t2*n* and time t2 at which the reference current value I2 is reached are obtained, and then, the area difference A1 is estimated. However, it is also possible to adopt a method in which the integrated current value is obtained using three or more reference current values. Various modified examples can also be considered as methods for determining the current area correction amount ΔTi.

In the above embodiment, the reference attainment time to be stored into the storage unit 14 has been set with the attainment time at normal temperature as a reference. Alternatively, the reference attainment time may include the reference attainment time under multiple temperature conditions such as the attainment time at the normal temperature of the fuel injection valve 2 and the attainment times in other specific temperature conditions, for example, at high temperatures such as 80° C. and 100° C. According to this, it becomes possible to learn and memorize the reference attainment time under a plurality of temperature conditions, and to execute the current area correction control more precisely according to the ambient temperature.

In the above embodiment, the information to be corrected by the information correction unit is configured to correct, for example, the reference current values I1 and I2. Alternatively, in addition to this, the current value itself detected by the current detection unit 7 and attainment time to reach each reference current I1, I2, the correction amount ΔTi, and the like may be corrected. In either case, the correction makes it possible to correct the current area more accurately. Further, in the above embodiment, the reference attainment time may be learned only when a predetermined temperature condition or the like is satisfied, which is configured to obtain the reference attainment time converted to room temperature based on the detected temperature.

The microcomputer 4 and the control IC 5 described above may be integrated, and in this case, it is desirable to use an arithmetic processing device capable of high-speed computing. The means and functions provided by the microcomputer 4 and the control IC 5 can be provided by software recorded in a substantial memory device and a computer, software, hardware, or a combination thereof for performing the software. For example, when the controller is provided by an electronic circuit that is hardware, it may be made of a digital circuit including one or more logic circuits, or an analog circuit. Further, for example, when the controller performs various kinds of control by software, a program is stored in the storage unit, and a method corresponding to the program is performed by the control body performing the program.

In addition, various changes can be made on the hardware configuration of the fuel injection valve, the booster circuit, the drive circuit, the current detection unit, and the like. While the present disclosure has been described in accordance with the embodiment, it is understood that the present disclosure is not limited to such embodiments or structures. The present disclosure also encompasses various modified examples and modifications within a uniform range. In addition, other combinations and configurations including further only a single element, more or less, are also within the spirit and scope of the present disclosure.

The control unit and the method according to the present disclosure may be achieved by a dedicated computer provided by constituting a processor and a memory programmed to execute one or more functions embodied by a computer program. Alternatively, the control unit and the method according to the present disclosure may be achieved by a dedicated computer provided by constituting a processor with one or more dedicated hardware logic circuits. Alternatively, the control unit and the method according to the present disclosure may be achieved using one or more dedicated computers constituted by a combination of the processor and the memory programmed to execute one or more functions and the processor with one or more hardware logic circuits. The computer program may be stored in a computer-readable non-transitional tangible recording medium as an instruction to be executed by the computer.

In the drawing, 1 is an electronic control device (injection control device), 2 is a fuel injection valve, 2*a* is a solenoid coil, 3 is a booster circuit, 4 is a microcomputer, 5 is a control IC, 6 is a drive circuit, and 7 is a current detector. 9 is a water temperature sensor, 11 is an energization control unit (current area correction control unit), 12 is a current monitor unit (information correction unit), 13 is an area correction amount calculation unit, and 14 is a storage unit.

The controllers and methods described in the present disclosure may be implemented by a special purpose computer created by configuring a memory and a processor programmed to execute one or more particular functions embodied in computer programs. Alternatively, the controllers and methods described in the present disclosure may be implemented by a special purpose computer created by configuring a processor provided by one or more special purpose hardware logic circuits. Alternatively, the controllers and methods described in the present disclosure may be implemented by one or more special purpose computers created by configuring a combination of a memory and a processor programmed to execute one or more particular functions and a processor provided by one or more hardware logic circuits. The computer programs may be stored, as instructions being executed by a computer, in a tangible non-transitory computer-readable medium.

It is noted that a flowchart or the processing of the flowchart in the present application includes sections (also referred to as steps). Further, each section can be divided into several sub-sections while several sections can be combined into a single section. Furthermore, each of thus configured sections can be also referred to as a device, module, or means.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. An injection control device for controlling fuel injection by driving a fuel injection valve with a current to supply a fuel to an internal combustion engine, the injection control device comprising:

a current detection unit that detects the current flowing through the fuel injection valve;

a current area correction control unit that performs current area correction for correcting and calculating, based on an energization current profile showing a relationship between an energization time and an energization current to obtain an integrated energization current value corresponding to a fuel injection amount command value, an area correction amount of an energization time to equalize the integrated current value of the energization current profile and an integrated current value of the current detected by the current detection unit according to a difference between the integrated current value of the energization current profile and the integrated current value of the current; and an information correction unit that learns and stores a reference attainment time, from a start of energization to an attainment of each of the plurality of reference currents when the fuel injection valve is driven under a predetermined voltage and temperature condition, in a storage unit, and corrects information related to the current area correction based on a difference between the reference attainment time and an actual attainment time from the start of energization to the attainment of each reference current when the fuel injection valve is driven after learning and storing.

2. The injection control device according to claim 1, further comprising:

a sensor that detects temperature information correlated with a temperature of the fuel injection valve, wherein:

the information correction unit learns and stores the reference attainment time in the storage unit using a correction coefficient for converting a detection value of the sensor into a value at a predetermined temperature condition.

3. The injection control device according to claim 1, further comprising:

one or more processors; and a memory coupled to the one or more processors and storing program instructions that when executed by the one or more processors cause the one or more processors to provide at least: the current area correction control unit and the information correction unit.

* * * * *